US007934712B2

(12) United States Patent
Boss

(10) Patent No.: US 7,934,712 B2
(45) Date of Patent: May 3, 2011

(54) DEVICE FOR COLLECTING PRINTED PRODUCTS ON A COLLECTING CYLINDER

(75) Inventor: Heinz Boss, Strengelbach (CH)

(73) Assignee: Mueller Martini Holding AG, Hergiswil (CH)

( * ) Notice: Subject to any disclaimer, the term of this patent is extended or adjusted under 35 U.S.C. 154(b) by 343 days.

(21) Appl. No.: 12/076,342

(22) Filed: Mar. 17, 2008

(65) Prior Publication Data

US 2008/0230974 A1 Sep. 25, 2008

(30) Foreign Application Priority Data

Mar. 20, 2007 (EP) ..... 07405089

(51) Int. Cl.
*B65H 29/54* (2006.01)

(52) U.S. Cl. ..... 270/19; 270/13; 270/47; 271/307; 271/308

(58) Field of Classification Search ..... 270/6, 13, 270/19, 42, 43, 47; 271/292, 294, 295, 296, 271/307, 308, 309, 310, 311, 312
See application file for complete search history.

(56) References Cited

U.S. PATENT DOCUMENTS

| | | | |
|---|---|---|---|
| 1,545,916 A | 7/1925 | Maxson | |
| 1,700,776 A | 2/1929 | Seymour | |
| 3,345,923 A | 10/1967 | Erk | |
| 6,620,088 B2 * | 9/2003 | Jeschke et al. | 493/426 |

FOREIGN PATENT DOCUMENTS

| | | |
|---|---|---|
| DE | 103 15 443 | 6/2004 |
| EP | 1 471 022 | 10/2004 |

OTHER PUBLICATIONS

Appendix to European Search Report dated Sep. 6, 2007 issued in Priority Application No. EP 07 40 4089.

* cited by examiner

*Primary Examiner* — Gene Crawford
*Assistant Examiner* — Leslie A Nicholson, III
(74) *Attorney, Agent, or Firm* — Venable LLP; Robert Kinberg; Leigh D. Thelen

(57) ABSTRACT

A device for collecting printed products includes a rotating collecting cylinder to and a controllable holding device that holds and releases the printed products collected in a peripheral area of the collecting cylinder. A diverter includes an exposed end and a support roller. The diverter has an operational position to lift the products off the collecting cylinder and transfer them onto a conveying device, and a non-operational position for collecting the products on the collecting cylinder. A control unit moves the diverter from the non-operational position during an interval between two successive printed products and with the timing of the supplied printed products, to the operational position in which the diverter's exposed end is inserted in the surface area of the collecting cylinder. A circulating control member is drive-connected to the collecting cylinder and includes at least one control cam associated with the support roller in the non-operational and operational positions of the diverter.

8 Claims, 8 Drawing Sheets

DEVICE FOR COLLECTING PRINTED PRODUCTS ON A COLLECTING CYLINDER

CROSS-REFERENCE TO RELATED APPLICATION

This application claims the priority of European Patent Application No. 07405089.9, filed on Mar. 20, 2007, the subject matter of which is incorporated herein by reference together with each U.S. and foreign patent and patent application mentioned herein.

BACKGROUND OF THE INVENTION

The invention relates to a device for collecting digitally and preferably sequentially printed products, which are supplied to a collecting cylinder that rotates around an axis, the device comprising a drive, a holding device for holding and releasing the printed products collected in the peripheral area of the collecting cylinder, an activation device for controlling the holding device, and a diverter with a pivoting axis that extends parallel to the collecting cylinder axis and can be used for lifting the collected printed products off the collecting cylinder, such that they can be transported away with the aid of a conveying device. For the collecting of the printed products, the diverter can be displaced by a control unit to a non-operating position during the interval between two successively following printed products and with the timing of the supplied printed products. For the conveying away of the printed products from the collecting cylinder, the diverter can be displaced to an operating position, in which the exposed end of the diverter is inserted into the surface area of the collecting cylinder.

German patent document DE 103 15 443 A discloses a device for collecting printed products, for example signatures for producing a newspaper, in the peripheral area of a collecting cylinder. The collected products can be released jointly and can be supplied, for example, to a folding machine. The collecting cylinder can simultaneously be embodied as a folding cylinder that is provided with folding blades in the peripheral area.

In order to collect the printed products in the peripheral area of the collecting cylinder, this cylinder is provided with a holding device that can be activated relative to the peripheral area of the collecting cylinder.

European patent document EP 1 471 022 A1 discloses a device for holding in place the printed products collected on a collecting cylinder with the aid of a holding mechanism, which comprises holding elements for holding down the printed products arriving at an end stop. A conveying belt that follows the collecting cylinder is provided for transporting away the printed products collected on the collecting cylinder. In order to transfer the collected printed products to the conveying belt, several transfer-out elements are provided, which form a diverter and can be pivoted around a pivoting axis extending parallel to the axis of rotation for the collecting cylinder. The transfer-out elements are inserted in the area of the collecting cylinder under the printed products to be transferred out. During the process of collecting the printed products, the transfer-out elements are pivoted away, such that they cannot enter the area of the collecting cylinder and are not operational. In one embodiment, the device is designed for assembling printed products that are sequentially printed in a digital printer.

SUMMARY

It is an object of the present invention to provide a device which can be used with a digital printer, but which makes possible a high output.

The above and other objects are accomplished according to the invention wherein there is provided, according to one embodiment, a device for collecting printed products, including a collecting cylinder that rotates around an axis and has a peripheral area to collect sequentially supplied printed products, a drive mechanism to rotate the collecting cylinder, a holding device operative to hold and release the printed products collected in the peripheral area of the collecting cylinder, and an activation device operative to control the holding device. The device also includes a diverter which includes a pivoting axis that extends parallel to the axis of the collecting cylinder, an exposed end and a support roller, such that the diverter has an operational position to lift the products off the collecting cylinder and transfer the products onto a conveying device, and a non-operational position to enable collection of the products on the collecting cylinder. A control unit is coupled to move the diverter from the non-operational position during an interval between two successively following printed products and with the timing of the supplied printed products, to the operational position in which the exposed end of the diverter is inserted in the surface area of the collecting cylinder. A concentrically circulating control member is drive-connected to the collecting cylinder. The control member includes at least one control cam operatively associated with the non-operational and operational positions of the diverter and which acts upon the support roller of the diverter.

With the device according to the invention, the diverter can be secured in a non-operating position for the collection of printed products by using a locking mechanism that is controlled by the control unit. In addition to controlling the device, the control unit with the connected locking mechanism for the diverter, also controls the printer and other devices used for producing the printed products. The printer is installed upstream of the collecting cylinder. The data required for producing the printed products are stored in the control unit and can be used with the device for controlling the diverter.

The device allows for the production of printed products at high output rates, which are comparable to the output rates of digital printers.

Another advantage of the device is that it allows collecting a variable number of sheet sections to form partial products with variable page numbers, especially in combination with a digital printer. The data required for this operation are stored in the control unit and the data can be used for controlling a printer, in particular a digital printer, and for controlling the diverter. The device is therefore especially suitable for collecting digitally printed sheets that are supplied sequentially, meaning one after another. On a dual-use collecting cylinder, for example, it is therefore possible to collect two products A and B which are different and have different formats.

According to one embodiment, the diverter can be pivoted to a non-operating position with the aid of the control member that rotates about the axis of the collecting cylinder. The diverter can respectively be pivoted to the non-operating position during an interval between two printed products, which are fed successively to the collecting cylinder or have already been collected thereon. For the process of collecting the printed products, the diverter is secured in the non-operating position by engaging in a locking mechanism. Once released from the locked position, the diverter is pivoted to an operating position, the collected printed products are lifted off the collecting cylinder, and the products are then conveyed by a conveying device. The control unit controls the steps of locking in place and releasing the diverter from the locking mechanism, thereby making possible the high output, flexibility, and comparably simple and secure control, as previously mentioned.

According to another embodiment, a particularly easy and secure control is possible if the control member is a circular disc with a radially outward pointing control cam.

This respectively allows the control cam to pivot the diverter to the non-operating position during an interval between two printed products.

According to another embodiment, the diverter can be secured if the diverter is detachably engaged in the locking mechanism for the non-operating position. A different embodiment provides for a movable latch on the locking mechanism for engaging the diverter, wherein this latch can be moved ahead of time with the timing for the supplied printed products. In this embodiment, the diverter is engaged detachably in the latch.

An especially easy and secure release from the locked position is possible according to a different embodiment of the invention, if a resetting force acts upon the latch and moves the latch to an idle position once the diverter is disengaged from the latch. The latch can be disengaged simply by pivoting the diverter with the aid of the control member, thereby removing the load from the latch. The resetting force subsequently pivots the latch immediately to an idle position, thereby releasing the diverter.

According to yet another embodiment of the invention, the locking mechanism comprises an adjustment element, which secures the latch in a position where the diverter is engaged, such that it cannot be disengaged. In this way, the latch can be locked in place easily and the collecting position determined. The adjustment element is connected to the control unit and is preferably embodied as an adjustment cylinder, in particular as a pneumatic cylinder. The latch can be held in the locked position and/or can be released from this position with the piston rod of the preferably dual-action adjustment cylinder.

According to a modified embodiment, the diverter is a control lever wherein the control lever operates jointly with the locking mechanism.

According to a different embodiment of the invention, a particularly easy and secure control is possible if the control lever pivots and has a support roller that moves along the adjustment elements for controlling the diverter.

The control lever comprises a locking mechanism, for example a locking disc, which engages in a latching nose of the latch when the diverter is pivoted to the non-operating position.

Another embodiment provides that the control lever can be pivoted counter to the resetting force, for example the force exerted by a spring element. If the control lever is no longer locked in place, the control lever automatically and immediately pivots to the operating position, in which the printed products are transported by the collecting cylinder.

A different embodiment comprises a control unit for controlling the locking mechanism. The control unit furthermore controls a printer, preferably a digital printer. This embodiment is particularly suitable for the sequential printing at high speeds of products composed of sequentially supplied digitally printed sheets. The printed products can furthermore be composed of partial products with variable page numbers. In this way, different types of printed products, for example newspapers, so-called broad sheets, but also tabloids, can be produced one after another.

According to one modified embodiment, the device is provided with an activation device for controlling the mechanism for holding and releasing of the printed products. As a result, the holding and releasing of the printed products can also be controlled with the aid of information supplied by the control unit, which permits an even higher output. The activation device advantageously operates jointly with a stationary first cam. The first cam has a different cam section for releasing the holding device. The holding device can at least approximately be compensated for by another cam section of a second cam. According to a different modification of the invention, the control of the holding device is particularly easy and secure if the second cam can moves between an inactive position and an active position. In the inactive position, the holding device is released. In the active position, the deviating cam section is approximately compensated for and the holding device is effective. The second cam can be advanced parallel to or approximately radial to the axis of rotation for the collecting cylinder. This configuration makes it possible to control the holding and releasing mechanism with the aid of a comparatively small lift, which can be achieved easily and quickly by using an adjustment cylinder.

The adjustment cylinder is preferably a pneumatic cylinder. However, a different type of adjustment cylinder and/or a different drive mechanism can in principle be used for displacing the cam.

BRIEF DESCRIPTION OF THE DRAWINGS

The present invention will be more readily understood from the following detailed description when read in conjunction with the accompanying drawings in which.

DETAILED DESCRIPTION

Figure 1:
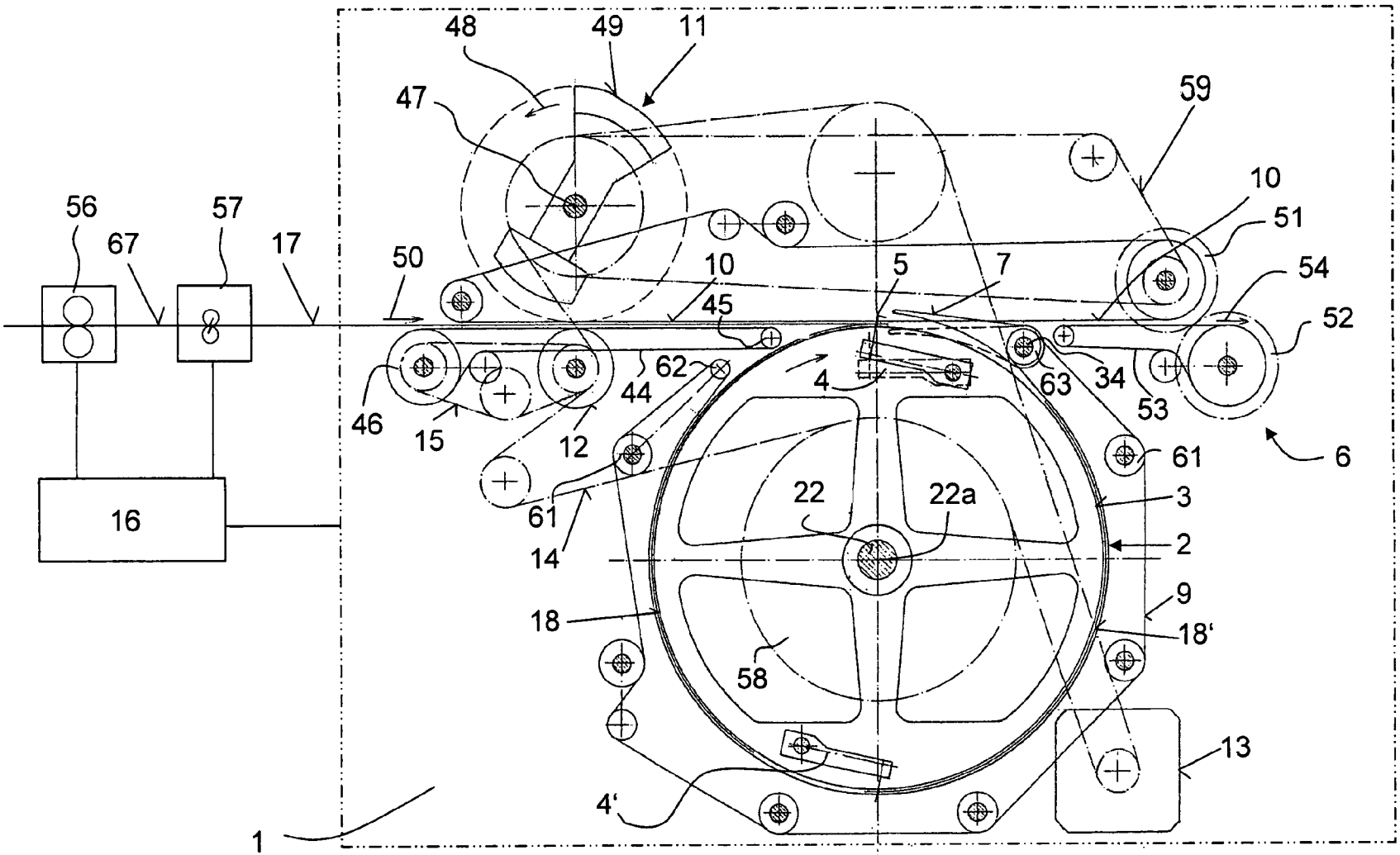
FIG. 1 is a schematic view from the side of the device according to the invention.
Figure 8:
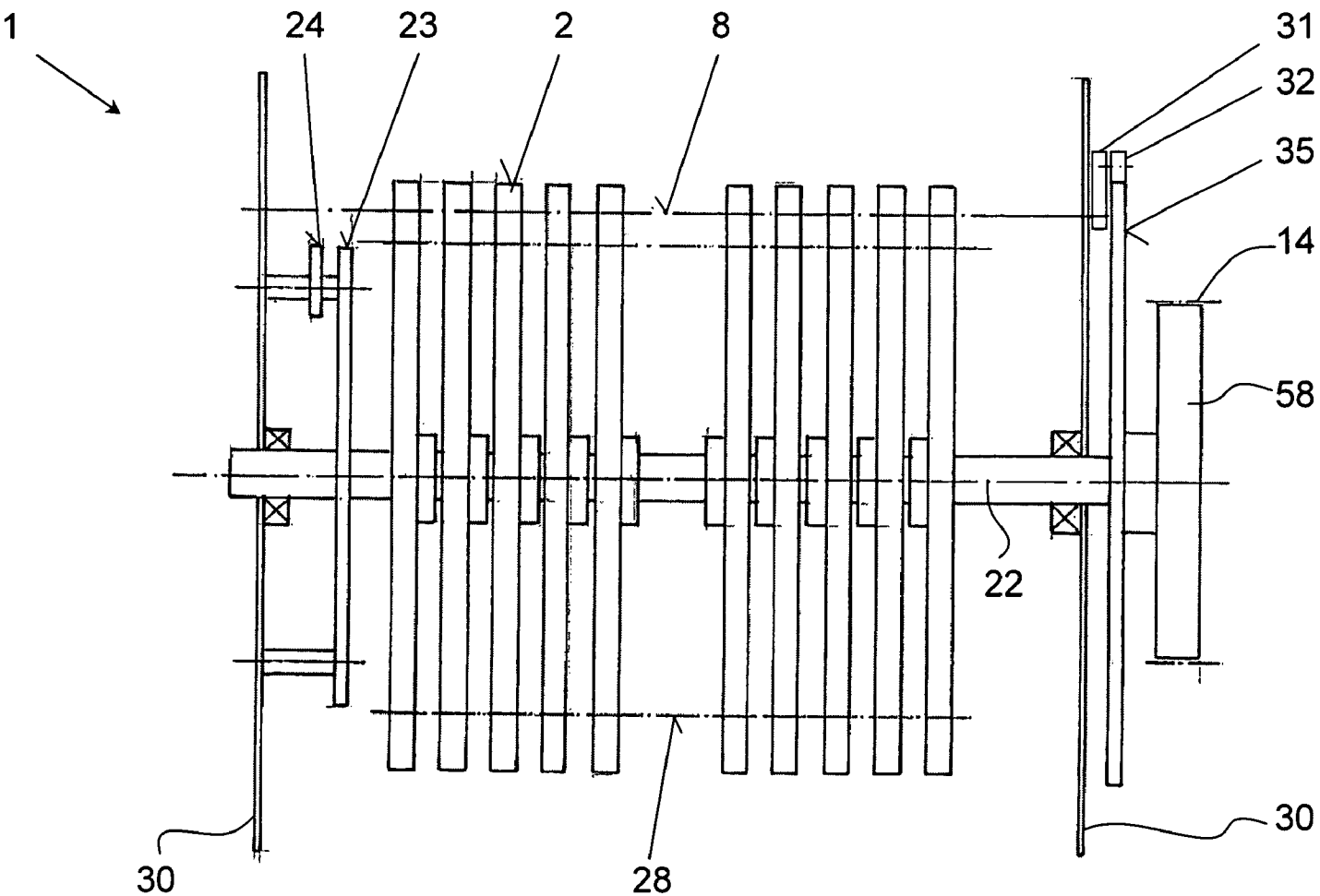
FIG. 8 is an additional partial view of the device according to FIG. 1.

The device 1 as shown in FIG. 1, comprises a collecting cylinder 2 having a shaft 22, which can rotate in a clockwise direction around an axis 22*a*. According to FIG. 8, the shaft 22*a* is positioned with both ends on a machine frame 30, such that it can rotate. A drive motor 13, in particular a servo motor, is used to drive the collecting cylinder 2 with the aid of a belt 14. The belt 14 is provided with toothing on both sides. The toothed belt 14 is fitted around a wheel 58, as shown in FIG. 1. The wheel 58 is arranged to the side and outside of the machine frame 30, as shown in FIG. 8. The wheel 58 is fixedly connect to the shaft 22 of the collecting cylinder 2. With the toothed belt 14 and a toothed belt 15, the drive motor 13 furthermore also drives a lower conveying belt 44 which is fitted over rollers 45 and 46. A counter-pressure cylinder 12 is operatively connected to the toothed belt 14 and the toothed belt 15. With the aid of the toothed belt 14, the drive motor 13 furthermore drives an acceleration element 11, which operates jointly with the counter-pressure cylinder 12 for accelerating a printed product 17 to be collected. The acceleration element 11 is provided for this with a peripheral area 49 that rotates around an axis 47 in the direction of arrow 48. With the aid of the toothed belt 14 and a toothed belt 59, the drive motor 13 also drives an upper wheel 51, a spur wheel, which engages in a different, lower spur wheel 52 of a conveying device 6. The upper wheel 51 drives an upper conveying belt 10 while the lower wheel drives a belt 53.

The collecting cylinder 2, the acceleration element 11, as well as the belts 10, 44 and 53 intended for the transport are therefore driven with synchronized speed and with the same timing by the drive motor 13. The drive motor 13 is supplied with the necessary information by a control unit 16, which is schematically indicated in FIG. 1, and also controls a printer 56 and a cross cutter 57. The printer 56 is preferably a digital printer. As indicated in FIG. 1, the cross cutter 57 cuts the paper web 67 in transverse direction into individual printed products 17. The paper web 67 is imprinted by the printer 56. The printed products 17 are transported from the left to the right in FIG. 1, as shown with the arrow 50. The rotational speed of the cross cutter 57, which is provided with a knife blade in the peripheral area, precisely corresponds to the speed of the acceleration element 11 and/or half the speed of the collecting cylinder 2, on which two sheet stacks 18 and 18' can be formed in the peripheral area 3. The collecting cylinder 2 is therefore embodied for a dual use. However, a design is also conceivable where the collecting cylinder 2 is embodied for only one use.

Figure 3:
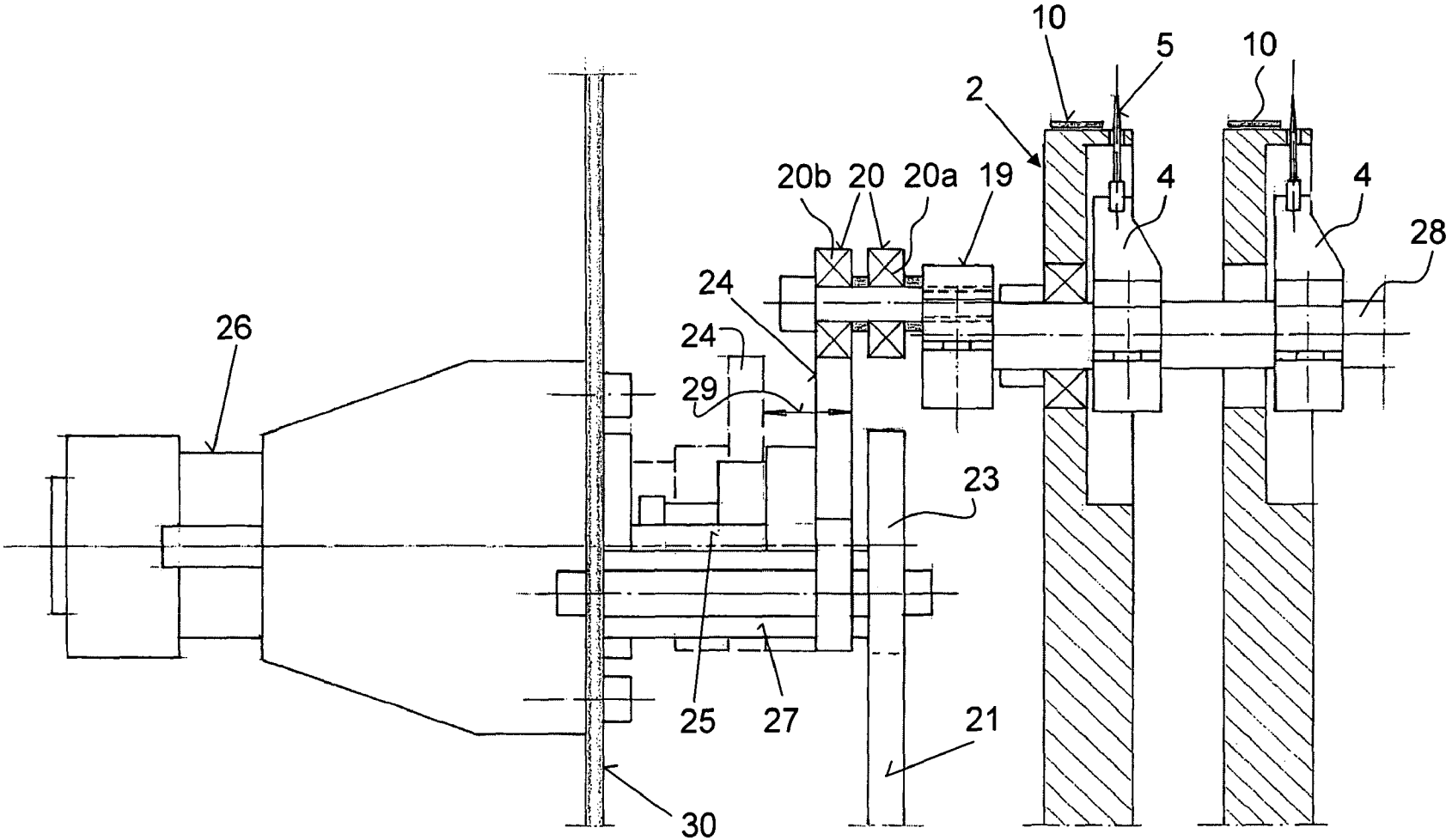
FIG. 3 is a partial sectional view of a detail of the device shown in FIG. 1.

Several holding devices 5 are provided for holding the printed products 17 in place on the collecting cylinder 2. As shown in FIG. 3, the holding device 5 can be embodied as punching needles which are respectively attached to the end of a lever 4. The acceleration element 11 and the needles on the collecting cylinder 2 are adjusted relative to each, such that the printed products 17 are speared by the extended needles at a location approximately 1 cm behind a leading edge. Once the collecting operation is completed, the levers 4 with the holding device 5 are pulled back, thereby releasing the printed products 17 that are collected into a sheet stack 18 on the collecting cylinder 2. A final printed product 17 is placed directly onto the sheet stack 18 that is collected on the cylinder 2, without being held down by the holding device 5 and being guided around the collecting cylinder 2. The collecting of the printed products 17 with the aid of the holding device 5 is explained further in the following paragraphs.

Figure 2:
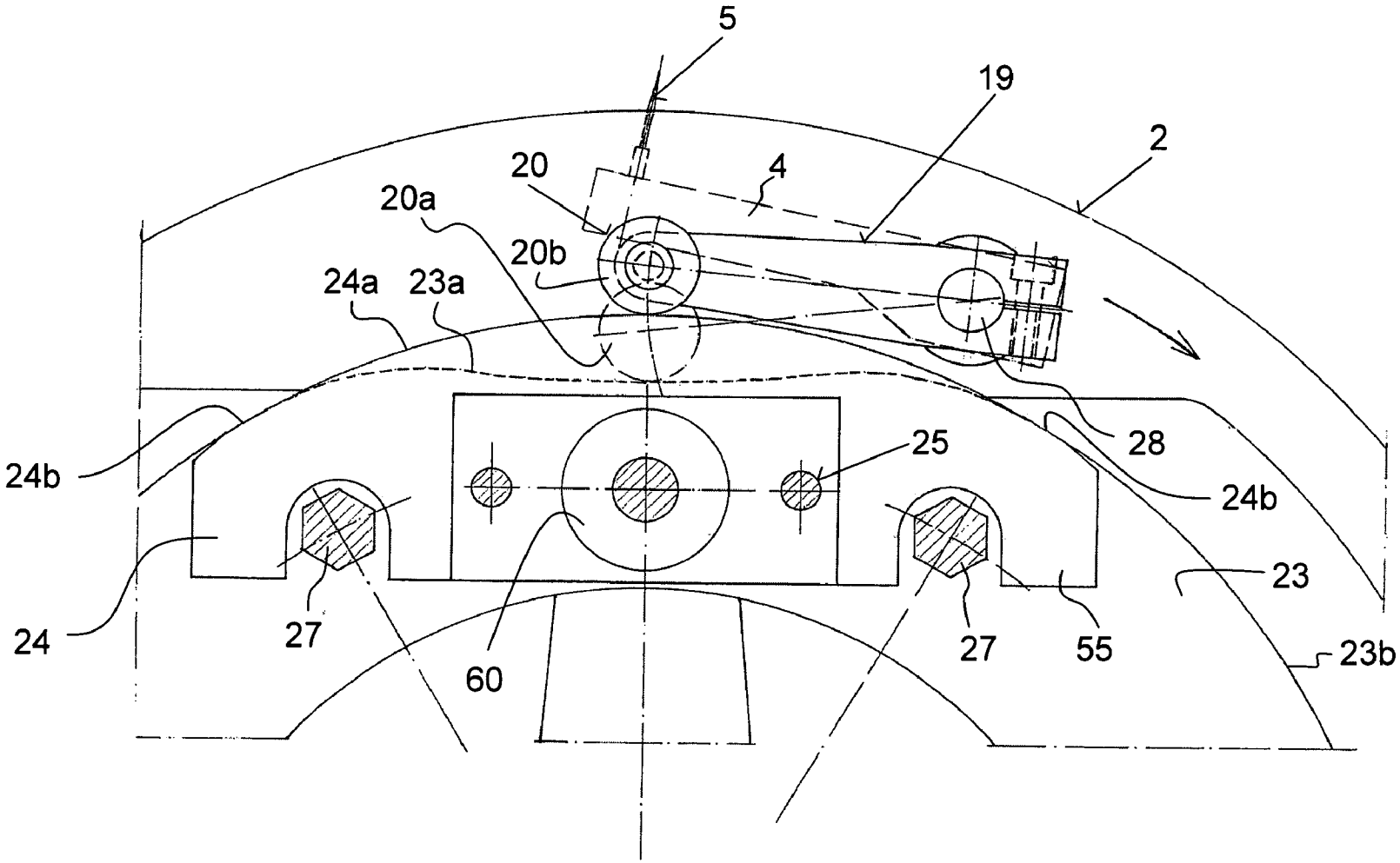
FIG. 2 is a partial view of the device according to FIG. 1.

The continuously drawn lines in FIG. 1 show the position of the holding device 5 and the lever 4, in which the holding device 5 is effective for collecting printed products 17. The dashed line of lever 4 in FIG. 1 shows the pulled-back position, in which the collected printed products 17 on the collecting cylinder 2 are not held down. At a distance to the holding device 5, the levers 4 are fixedly connected to the shaft 28 that is shown in FIG. 3. The shaft 28 is positioned rotating in the collecting cylinder 2. As shown in FIGS. 2 and 3, an activation device 19 is attached to one end of shaft 28, and is provided at a distance to the shaft 28 with two cam rollers 20. The cam roller 20*a*, shown in FIG. 3, runs at least in some sections along a cam section 23*b* of a cam 23 while the cam roller 20*b* runs along a cam section 24*b* of a cam 24. The cam 23 and the cam 24 are stationary, meaning they do not rotate along with the collecting cylinder 2. However, the cam 24 can be displaced, for example in axial direction, with the aid of the stroke illustrated in FIG. 3 by double arrow 29. The one position of the cam 24 is shown in FIG. 3 with continuous lines while the other position is shown with dashed lines. The cam 24 can also be advanced either parallel or radial to the axis of rotation for the collecting cylinder 2. It is furthermore conceivable that the cam 24 is positioned so as to pivot around the axis of rotation 22 or an axis that is parallel to the axis of rotation 22. The cam 23 cannot be displaced and is attached with several bolts 27 to the machine frame 30. The cam 24 is guided linearly by a guide element 25. A pneumatic cylinder 26, which is attached to the machine frame 30, is responsible for the movement in the axial direction. The cam 24 is connected directly to a piston rod 60 of the pneumatic cylinder 26 (FIG. 2), wherein a different drive element can also be used in place of a pneumatic cylinder. A control unit 16 is responsible for the timely activation of the pneumatic cylinder 26. The control unit 16 also controls the digital printer 56 and the cross cutter 57. The necessary information is stored in the control unit 16, for example relating to the number of pages required for each partial product of a newspaper, meaning the number of printed products 17 which must be collected with the device to form a sheet stack 18.

According to FIG. 2, the cam 23 has a deviating cam section 23*a*, meaning the track 21 is not completely circular. FIG. 2 also shows that the cam 24 is positioned in front of this deviating cam section 23*a* and is provided with a cam section 24*a*, which at least approximately compensates for the deviating cam section 23*a* of the cam 23. FIG. 3 shows that if the cam 23 is in the position indicated with the continuous lines, then the deviating curve section 23*a* is not effective since the activation device 19 with the cam roller 20*b* is lifted in this cam section 23*a* to be above the cam section 24*a* of the cam 24. The deviating cam section 23*a* is thus compensated at least approximately by the cam 24. The respective position of the activation device 19 is shown in FIG. 2 with continuous lines. However, if the cam 24 is in the position shown with dashed lines in FIG. 3, it does not become effective and the cam roller 20*b* accordingly is not activated. In that case, the activation device 19 is controlled solely by the cam roller 20*a*, which then enters the area of the deviating cam section 23*a*. As shown in FIG. 2, when the cam roller 20*a* enters this area, the activation device 19 moves radially downward causing the levers 4 with the holding device 5 to also move downward in radial direction. The holding device 5 consequently releases the printed products 17 collected on the collecting cylinder 2.

The belts 9 run over the rollers 61 and are driven by the collecting cylinder 2. The holding device 5 is located in a gap that respectively exists between two belts 9, offset in the axial direction of the collecting cylinder axis 22, and the deflection rollers 61, 62 and 63. The position of the holding device 5 can thus be controlled easily by axially displacing the cam 24 with the pneumatic cylinder 26. To collect the printed products 17, the cam 24 is thus moved to the position shown in FIG. 3 with continuous lines. Once the collecting operation is completed, the cam 24 is displaced with the aid of the pneumatic cylinder 26 in the axial direction and linearly toward the outside, so that the cam roller 20*a* can withdraw into the deviating cam section 23*a* and the collected printed products 17 can be released by the holding device 5. As previously mentioned, the pneumatic cylinder 26 is activated by the control 16.

FIG. 1 shows that opposite the levers 4 the collecting cylinder 2 is provided with additional levers 4'. The levers 4 and 4' comprise holding devices 5 and are also controlled by the cams 23 and 24, as explained in the above. The levers 4' function to hold in place the printed products 17 of the sheet stack 18' while the levers 4 function to hold in place the printed products 17 of the sheet stack 18.

Once the holding devices 5 have released the sheet stacks 18 and 18', these are lifted off the collecting cylinder by a diverter 7 and are transferred out with a conveying device 6. During the collecting operation, the diverter 7 is in the non-operating position shown with continuous lines in FIG. 1. For the transfer-out operation, the diverter 7 is pivoted to the operating position, shown with dashed lines in FIG. 1. The diverter 7 is controlled with the aid of a rotating control member 35, shown in FIGS. 4 to 8. A control lever 31 moves along the control member 35. A diverter spar 34 with a pivoting axis 8 fixedly connects the diverter 7 and the control lever 31. At a distance to the diverter spar 34, the control lever 31 is provided with a support roller 32 proximate an exposed end 31*a*. The exposed end 31*a* moves in the peripheral area of the rotating control member 35. Control member 35, control lever 31 and support roller 32 are arranged outside of machine frame 30. The diverter spar 34 is extended up to the outside of machine frame 30, as shown by pivoting axis 8 in FIG. 8. Between the diverter spar 34 and the support roller 32, a spring element 33 acts upon the control lever 31. The support roller 32 is pressed against the control member 35 with the aid of this spring element 33, for example a compression spring. According to FIGS. 4 and 5, the control member 35 has a radially outward pointing control cam 36. The control cam 36 functions to slightly lift the support roller 32 each time. The diverter 7 accordingly is pivoted radially toward the outside. The control cam 36 is arranged such that the pivoting always occurs during an interval between the two sheet stacks 18 and 18'. This prevents the diverter 7 from coming in contact with the collected printed products on the collecting cylinder. Preferably, the control member 35 comprises a plurality of control cams 36 operatively associated with a respective one of the printed products, only one control cam 36 being show for ease of illustration.

Figure 5:
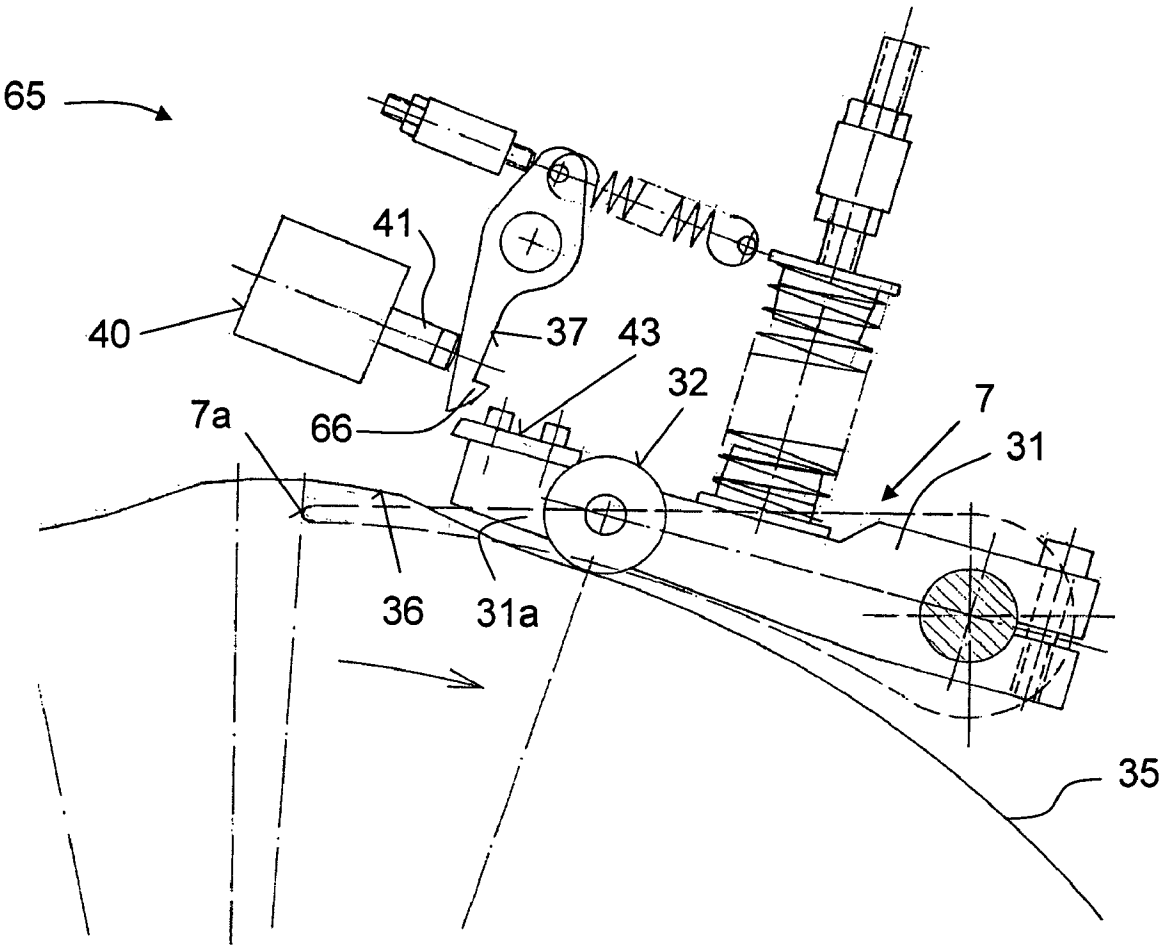
FIGS. 5-7 are different partial views of the device according to FIG. 1, shown in different operating positions.
Figure 6:
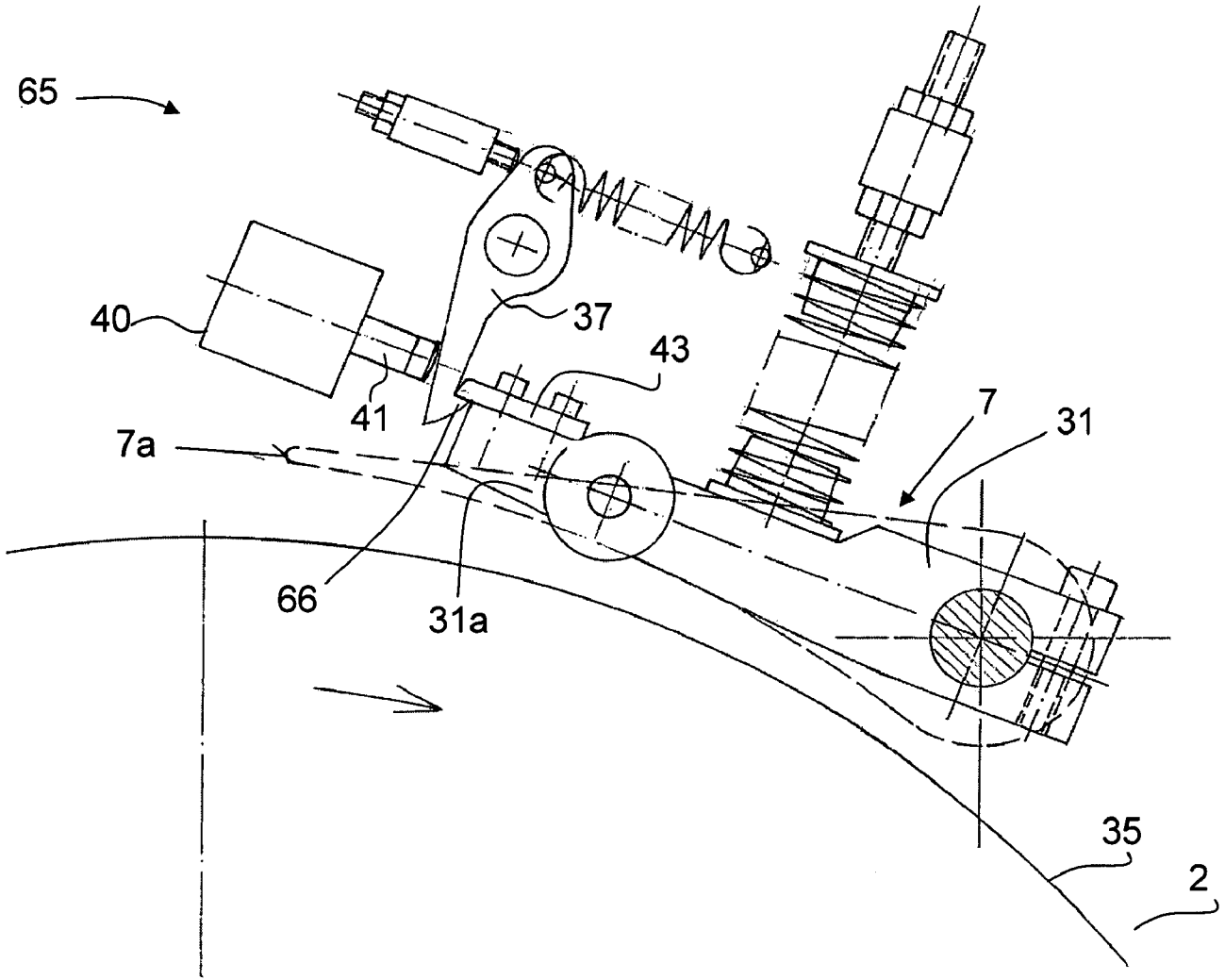
Figure 7:
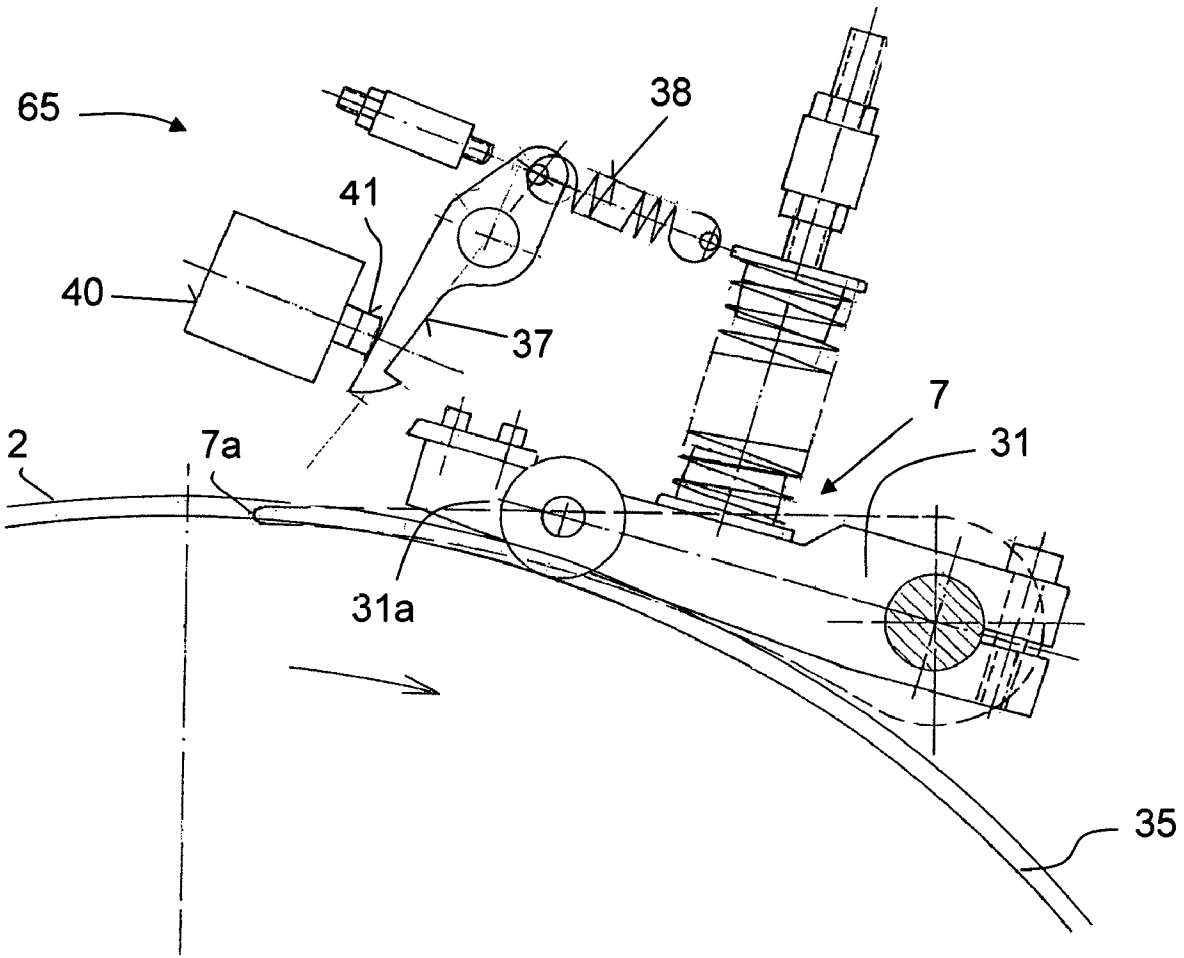

As shown in FIG. 6, during the collecting of the printed products 17 into sheet stacks 18, the diverter 7 is kept in a raised position by a latch 37 of a locking mechanism 65. In this position, the diverter 7 consequently does not extend into the collection cylinder 2. According to FIG. 4, the latch 37 can be pivoted around an axis 64 from a position shown with continuous lines to a position shown with dashed lines. However, the pivoting movement cannot be realized if a piston rod 41 of a pneumatic cylinder 40 is extended, as shown in FIGS. 5 and 6. A resetting force 38, for example generated by a tension spring that acts upon the latch 37, effects a rotational moment in a clockwise direction. An end stop 39 limits the movement in the counter-clockwise direction. The latch 37 is in the position shown in FIG. 7 if the piston rod 41 is retracted. The latch 37 is in the position shown in FIG. 5 if the piston rod 41 is extended.

A snap-in mechanism 43 that operates jointly with the latch 37 is arranged on the control lever 31. If the latch 37 is in the position shown in FIG. 5, the snap-in mechanisms 43 engages in a latch nose 66 on the latch 37 as soon as the support roller 32 moves onto the control cam 36. The piston rod 41 moves back only slightly during the engagement. If the piston rod 41 remains extended, then the diverter 7 is secured in the position shown in FIG. 6. The printed products 17 can thus be collected on the collection cylinder 2 while the diverter 7 is in the non-operating position.

Figure 4:
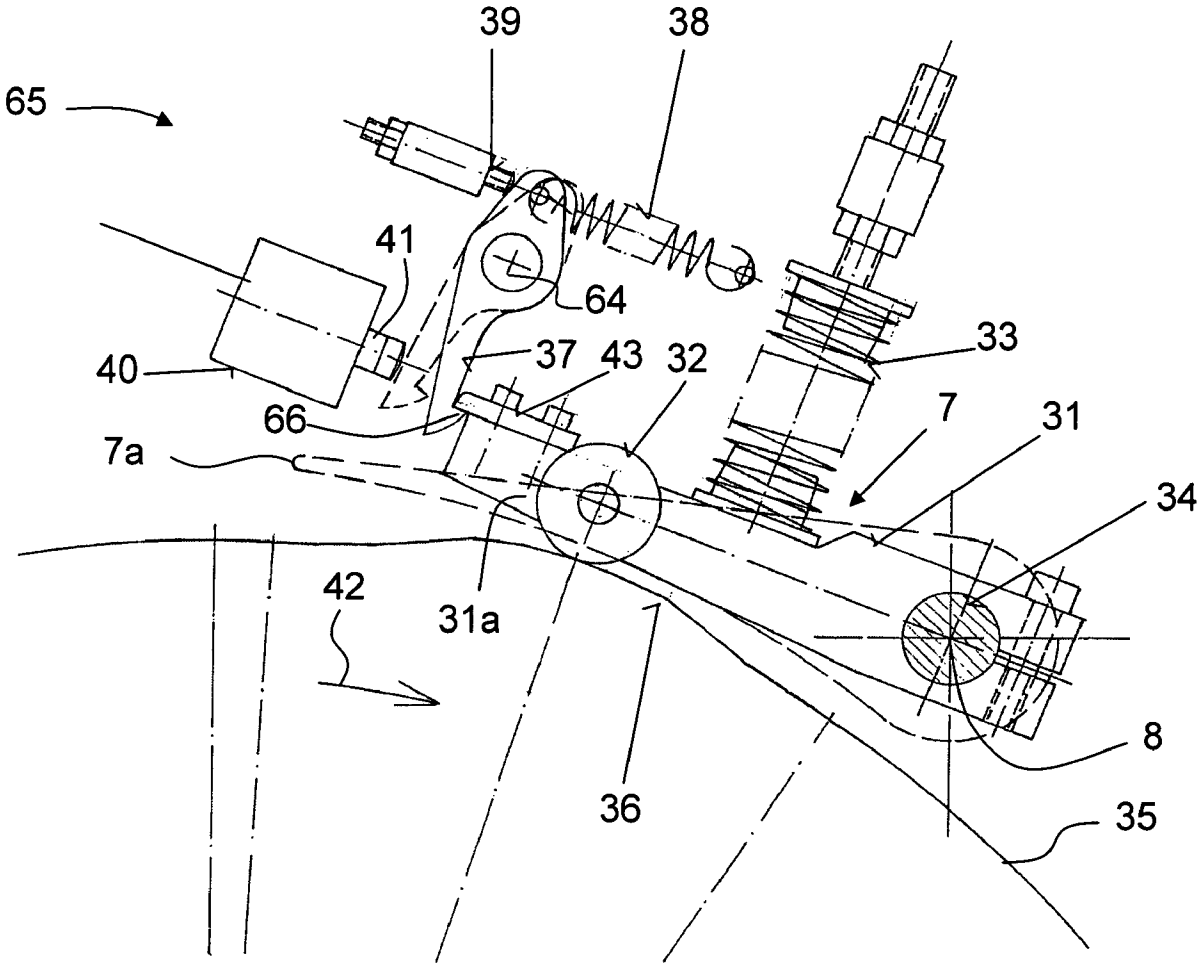
FIG. 4 is a partial view of the device according to FIG. 1.

For the transfer of a completed sheet stack 18 or 18', the piston rod 41 is retracted to the position shown in FIG. 4 as soon as the control cam 36 that is assigned to the leading sheet stack 18 or 18', leaves the area of the locking mechanism and/or the support roller 32. However, the diverter 7 remains for the time being in the raised position because the comparatively strong spring element 33 still presses the snap-in mechanism 43 against the latch nose 66. The comparatively weak resetting force 38 is not able to pull the latch 37 away from the snap-in mechanism 43. If the control cam 36, which is assigned to the sheet stack 18 and/or 18' to be transferred out, moves into the area of the support roller 32, then this support roller and thus also the snap-in mechanism 43 are raised up slightly in radial direction. As a result, the pressure exerted by the snap-in mechanism 43 onto the latch 37 is reduced. Thus, the resetting force 38 can pivot the latch 37 into the position shown in FIG. 4 with dashed lines. The snap-in mechanism 43 is thus released and the diverter 7 is pivoted into the position shown in FIG. 7. This is caused as a result of the pressure exerted by the spring element 33, which presses the support roller 32 against the control member 35. In this position, the exposed end 7*a* of the diverter 7 extends into the plane for the surface of the collecting cylinder 2 and the sheet stack 18 or 18' is then lifted off the collecting cylinder 2. The sheet stack 18 or 18' is transferred with the aid of the belts 10 and 53 of the conveying device 6. The control unit 16 is therefore also responsible for the correct and timely activation of the adjustment element 40 by an electromagnetic valve that is not shown herein.

Upon completion of the transfer operation and to restart the collecting of printed products 17 into stacks 18, 18', the piston rod 41 of the adjustment element 40 is extended as soon as the control cam 36, associated with the preceding use, leaves the area of the locking mechanism and/or the support roller. If the support roller 32 is lifted in radial direction off the following control cam 36, the snap-in mechanism 43 is also lifted up. As previously explained, the snap-in mechanism 43 is secured immovably in the locking mechanism 65.

The device provides a comparatively long time interval for activating the adjustment element 40 of the locking mechanism 65. The piston rod 41 can be moved to the position necessary for the following use, as soon as the control cam 36 of the control member 35 leaves the area of the locking mechanism and/or the support roller 32. The time interval between two successively following control cams 36 of the circulating control member 35 is thus available for the advance control of the adjustment element 40. The holding device 5 for holding and releasing the printed products collected in the peripheral area 3 of the collecting cylinder 2 can also be activated in advance, as described in the above. The cam 24 can be advanced and/or withdrawn immediately after the circulating cam rollers 20 leave the area of the deviating cam section 23*a*. The circulating cam rollers 20 are connected to the collecting cylinder 2. The adjustment operation must be completed before the following use, meaning by the time the circulating cam rollers pass through the area of the deviating cam section 23*a* of the cam 23. As a result, the device is particularly suitable for the high printing speeds of digital printers, for example speeds more than approximately 2 m/s. The collecting of printed products 17 on the collecting cylinder 2 is a separate operation from the cross cutting and folding. The device is therefore especially suitable for use in connection with a digital printer for the sequential production of partial products with a varying number of pages, for example for the production of newspapers. A variable number of printed products can thus be compiled into partial products having a different number of pages and no manual intervention is required for different formats. The device consequently makes possible a high digital printing output and, simultaneously, provides a high flexibility for assembling the printed products.

It will be understood that the above description of the present invention is susceptible to various modifications, changes and adaptations, and that the same are intended to be comprehended within the meaning and range of equivalents of the appended claims.

What is claimed is:

1. A device for collecting printed products, comprising:

a collecting cylinder that rotates around an axis and has a peripheral area to collect sequentially supplied printed products;

a drive mechanism to rotate the collecting cylinder;

a holding device operative to hold and release the printed products collected in the peripheral area of the collecting cylinder;

an activation device operative to control the holding device;

a diverter comprising a single-arm control lever, the single-arm control lever including a pivoting axis that extends parallel to the axis of the collecting cylinder, an exposed end and a support roller positioned proximate to the exposed end of the single-arm control lever, wherein the diverter has an operational position to lift the products off the collecting cylinder and transfer the products onto a conveying device, and a non-operational position to enable collection of the products on the collecting cylinder;

a control unit coupled to move the diverter from the non-operational position during an interval between two successively following printed products and with the timing of the supplied printed products, to the operational position in which the exposed end of the diverter is inserted in the surface area of the collecting cylinder; and a concentrically circulating control member drive-connected to the collecting cylinder, the control member comprising at least one control cam operatively associated with the non-operational and operational positions of the diverter and which acts upon the support roller of the diverter.

2. The device according to claim 1, further comprising a spring element that presses the control lever against the control member.

3. The device according to claim 1, wherein the control member comprises a plurality of control cams operatively associated with a respective one of the printed products.

4. The device according to claim 1, wherein the control member comprises an approximately circular disc having a peripheral area that includes at least one radially outward projecting control cam.

5. A device for collecting printed products, comprising:

a collecting cylinder that rotates around an axis and has a peripheral area to collect sequentially supplied printed products;

a drive mechanism to rotate the collecting cylinder;

a holding device operative to hold and release the printed products collected in the peripheral area of the collecting cylinder;

an activation device operative to control the holding device;

a diverter including a pivoting axis that extends parallel to the axis of the collecting cylinder, an exposed end and a support roller, wherein the diverter has an operational position to lift the products off the collecting cylinder and transfer the products onto a conveying device, and a non-operational position to enable collection of the products on the collecting cylinder;

a control unit coupled to move the diverter from the non-operational position during an interval between two successively following printed products and with the timing of the supplied printed products, to the operational position in which the exposed end of the diverter is inserted in the surface area of the collecting cylinder;

a concentrically circulating control member drive-connected to the collecting cylinder, the control member comprising at least one control cam operatively associated with the non-operational and operational positions of the diverter and which acts upon the support roller of the diverter; and a locking mechanism to lock the diverter in the non-operational position.

6. The device according to claim 5, wherein the locking mechanism is coupled to the control unit and comprises a latch controlled with the timing of the supplied printed products, and secured in place counter to a resetting force.

7. The device according to claim 6, further comprising an adjustment element coupled to the control unit that acts upon the latch.

8. The device according to claim 6, further comprising a snap-in mechanism of the diverter, wherein the latch comprises a latch nose to engage in the snap-in mechanism.

* * * * *